US012163243B2

(12) United States Patent
Taguchi et al.

(10) Patent No.: US 12,163,243 B2
(45) Date of Patent: Dec. 10, 2024

(54) SURFACE-TREATED STEEL SHEET, METAL CONTAINER, AND METHOD FOR MANUFACTURING SURFACE-TREATED STEEL SHEET

(71) Applicant: TOYO KOHAN CO., LTD., Tokyo (JP)

(72) Inventors: Naomi Taguchi, Kudamatsu (JP); Akihiro Yoshida, Kudamatsu (JP); Kenji Yanada, Yokohama (JP)

(73) Assignee: TOYO KOHAN CO., LTD., Tokyo (JP)

( * ) Notice: Subject to any disclaimer, the term of this patent is extended or adjusted under 35 U.S.C. 154(b) by 0 days.

(21) Appl. No.: 18/012,819

(22) PCT Filed: May 25, 2021

(86) PCT No.: PCT/JP2021/019835
§ 371 (c)(1),
(2) Date: Dec. 23, 2022

(87) PCT Pub. No.: WO2021/261155
PCT Pub. Date: Dec. 30, 2021

(65) Prior Publication Data

US 2023/0257898 A1 Aug. 17, 2023

(30) Foreign Application Priority Data

Jun. 26, 2020 (JP) ..... 2020-110228

(51) Int. Cl.
*C25D 11/36* (2006.01)
*B65D 8/00* (2006.01)
(Continued)

(52) U.S. Cl.
CPC ..... *C25D 11/36* (2013.01); *B65D 7/04* (2013.01); *B65D 65/42* (2013.01); *C25D 3/30* (2013.01); *C25D 9/06* (2013.01); *C25D 9/08* (2013.01)

(58) Field of Classification Search
None
See application file for complete search history.

(56) References Cited

U.S. PATENT DOCUMENTS

2018/0010259 A1* 1/2018 Yoshimura ..... C25D 5/48
2018/0016693 A1 1/2018 Yoshimura et al.
(Continued)

FOREIGN PATENT DOCUMENTS

EP 3 508 617 A1 7/2019
JP 2006-348360 A 12/2006
(Continued)

OTHER PUBLICATIONS

International Search Report of PCT/JP2021/019835 dated Aug. 17, 2021 [PCT/ISA/210].
(Continued)

*Primary Examiner* — Daniel J. Schleis
(74) *Attorney, Agent, or Firm* — Sughrue Mion, PLLC

(57) ABSTRACT

A surface-treated steel sheet including a tin-plated steel sheet having a tin plating on a steel sheet; a tin oxide layer formed on the tin-plated steel sheet and containing tin oxide as a main component; a composite oxide layer formed on the tin oxide layer and containing phosphoric acid and aluminum as main components; and an aluminum-oxygen compound layer formed on the composite oxide layer and containing an aluminum-oxygen compound as a main component, wherein the tin oxide layer has a thickness of 8 to 20 nm.

1 Claim, 5 Drawing Sheets

(51) Int. Cl.

| | |
|---|---|
| ***B65D 65/42*** | (2006.01) |
| ***C25D 3/30*** | (2006.01) |
| ***C25D 9/06*** | (2006.01) |
| ***C25D 9/08*** | (2006.01) |

(56) References Cited

U.S. PATENT DOCUMENTS

| | | | |
|---|---|---|---|
| 2021/0310143 | A1 | 10/2021 | Yoshimura et al. |
| 2021/0310146 | A1 | 10/2021 | Yoshimura et al. |

FOREIGN PATENT DOCUMENTS

| | | | |
|---|---|---|---|
| JP | 2018-035394 | A | 3/2018 |
| WO | 2016/121275 | A1 | 8/2016 |
| WO | 2016/121276 | A1 | 8/2016 |

OTHER PUBLICATIONS

Office Action issued Jul. 30, 2024 in Japanese Application No. 2020-110228.
Extended European Search Report issued Jul. 12, 2024 in Application No. 21830198.4.

* cited by examiner

SURFACE-TREATED STEEL SHEET, METAL CONTAINER, AND METHOD FOR MANUFACTURING SURFACE-TREATED STEEL SHEET

CROSS REFERENCE TO RELATED APPLICATIONS

This application is a National Stage of International Application No. PCT/JP2021/019835, filed May 25, 2021, claiming priority to Japanese Patent Application No. 2020-110228, filed Jun. 26, 2020.

TECHNICAL FIELD

The present invention relates to a surface treated steel sheet, a metal container, and a method for manufacturing a surface treated steel sheet.

BACKGROUND ART

Chromate treatment is a known technique for treating the surfaces of base materials for use in the fields of metal containers, consumer electronics, building materials, vehicles, aircraft, and the like. Further, non-chromic surface treatment as an alternative to such chromate treatment has also been developed. For example, Patent Document 1 discloses a non-chromic surface treatment technique comprising subjecting a steel sheet to an immersion treatment or a cathode electrolytic treatment in a chemical conversion treatment solution containing tetravalent Sn ions and phosphate ions after forming a Sn-containing plating layer on at least one side of the steel sheet; and then subjecting the steel sheet to an immersion treatment or a cathode electrolytic treatment in a chemical conversion treatment solution containing aluminum dihydrogen phosphate, followed by drying.

RELATED ART DOCUMENTS

Patent Document

Patent Document 1: JP 2006-348360 A

SUMMARY OF THE INVENTION

Problem to be Solved by the Invention

One problem of the conventional technique disclosed in Patent Document 1 is that in the case where a coating layer formed from an organic material is famed on a steel sheet surface-treated by the technique, due to poor adhesion to the coating layer formed from an organic material, the resulting steel sheet is not suitable for applications to products including a coating layer famed from an organic material, such as food/beverage can applications.

An objective of the present invention is to provide a surface-treated steel sheet which has a surface with a good appearance, has excellent sulfide staining resistance and alkali resistance, and has high adhesion to a coating layer.

Means for Solving Problems

As a result of dedicated studies to achieve the above objective, the present inventors have found that the objective can be achieved by forming a tin oxide layer containing tin oxide as a main component, a composite oxide layer containing phosphoric acid and aluminum as main components, and an aluminum-oxygen compound layer containing an aluminum-oxygen compound as a main component in the stated order on a tin-plated steel sheet by non-chromic surface treatments, and controlling the thickness of the tin oxide layer within a specific range. This finding has led to the completion of the present invention.

Specifically, the present invention provides a surface-treated steel sheet comprising:

- a tin-plated steel sheet having a tin plating on a steel sheet;
- a tin oxide layer formed on the tin-plated steel sheet and containing tin oxide as a main component;
- a composite oxide layer formed on the tin oxide layer and containing phosphoric acid and aluminum as main components; and
- an aluminum-oxygen compound layer formed on the composite oxide layer and containing an aluminum-oxygen compound as a main component, wherein the tin oxide has a thickness of 8 to 20 nm.

In the surface-treated steel sheet according to the present invention, the tin oxide layer preferably shows a diffraction pattern arising from the crystalline structure of tin(IV) oxide ($SnO_2$) when the tin oxide layer is subjected to diffraction pattern analysis by nano-beam electron diffraction using a transmission electron microscope.

In the surface-treated steel sheet according to the present invention, the tin oxide layer preferably has a Sn atom content of 30 atomic % or more and less than 50 atomic %, a P atom content of 2 to 14 atomic %, and an Al atom content of 3 to 15 atomic % based on 100 atomic % of total Sn, P, Al, O, and Fe atoms present in the tin oxide layer.

In the surface-treated steel sheet according to the present invention, the atomic ratio P/Al of P atoms to Al atoms in the tin oxide layer is preferably 0.5 or more and less than 1.5.

In the surface-treated steel sheet according to the present invention, the atomic ratio P/Al of P atoms to Al atoms in the aluminum-oxygen compound layer is preferably 0.02 to 0.5.

In the surface-treated steel sheet according to the present invention, the amount of tin deposited is preferably 5.6 $g/m^2$ or more.

The present invention also provides a metal container comprising the surface-treated steel sheet according to the present invention.

The present invention further provides a method for manufacturing a surface-treated steel sheet, the method comprising:

- a first step of providing a tin-plated steel sheet having a tin plating on a steel sheet;
- a second step of subjecting the tin-plated steel sheet to an electrolytic treatment in an electrolytic treatment solution containing phosphate ions with 0.1 $C/dm^2$ or more and 1.0 $C/dm^2$ or less of electricity; and
- a third step of subjecting the tin-plated steel sheet subjected to the electrolytic treatment in the second step to a cathode electrolytic treatment in an electrolytic treatment solution containing aluminum ions.

Effects of Invention

The present invention can provide a surface-treated steel sheet which has a surface with a good appearance, has excellent sulfide staining resistance and alkali resistance, and has high adhesion to a coating layer.

DESCRIPTION OF EMBODIMENTS

Figure 1:
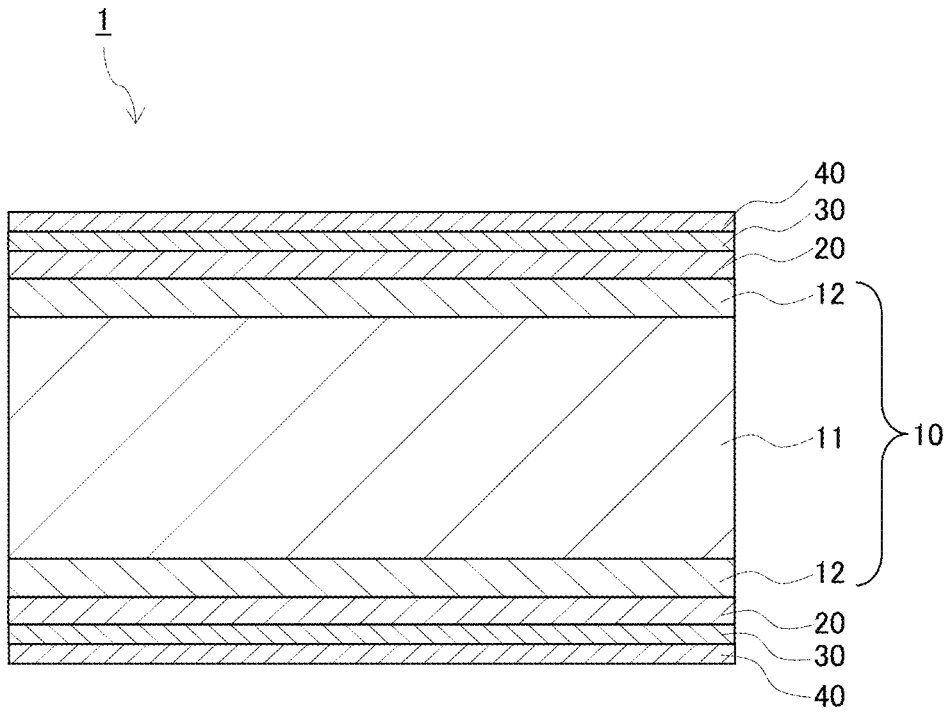
FIG. 1 is a cross-sectional view illustrating the structure of a surface-treated steel sheet according to an embodiment of the present invention.

FIG. 1 is a cross-sectional view illustrating the structure of a surface-treated steel sheet 1 according to an embodiment of the present invention. The surface-treated steel sheet 1 according to the present embodiment comprises a tin oxide layer 20 containing tin oxide as a main component, a composite oxide layer 30 containing phosphoric acid and aluminum as main components, and an aluminum-oxygen compound layer 40 containing an aluminum-oxygen compound as a main component in the stated order on a tin-plated steel sheet 10 having a tin plating layer 12 formed on a steel sheet 11. Although the example shown in FIG. 1 has a structure in which the tin oxide layer 20, the composite oxide layer 30, and the aluminum-oxygen compound layer 40 are formed on each of both sides of the tin-plated steel sheet 10, what is required is a structure including the tin oxide layer 20, the composite oxide layer 30, and the aluminum-oxygen compound layer 40 on at least one side of the tin-plated steel sheet 10.

The surface-treated steel sheet 1 according to the present embodiment can be used as a can container member or a can lid member, for example. In the case where the surface-treated steel sheet 1 is used as a can container member, a can lid member, or the like, the surface-treated steel sheet 1 may be used as it is (as a paintless sheet without a coating layer on the surface) and shaped into a paintless can container or can lid, or may be shaped into a can container, a can lid, or the like after a coating layer formed from an organic material is formed on the aluminum-oxygen compound layer 40. It should be noted that the coating layer famed from an organic material is typically formed on a side corresponding to the inner surface of a can container or a can lid (i.e., the side to be in contact with a content).

<Tin-Plated Steel Sheet 10>

The tin-plated steel sheet 10 as a base material of the surface-treated steel 1 according to the present embodiment can be obtained by tin plating the steel sheet 11 to form the tin plating layer 12 on the steel sheet 11.

The thickness of the tin-plated steel sheet 10 is not specifically limited, and may be selected depending on the intended use of the surface-treated steel sheet 1. The thickness is preferably 0.07 to 0.4 mm.

<Tin Oxide Layer 20>

The tin oxide layer 20 is formed on the tin plating layer 12 of the tin-plated steel sheet 10, and contains tin oxide as a main component.

The tin oxide layer 20 may be any layer containing tin oxide as a main component. In the present embodiment, the tin oxide layer 20 may be a layer having a Sn atom content of 30 atomic % or more and an O atom content of 30 atomic % or more and less than 50 atomic %. The Sn atom content and the O atom content can be determined as the percentage of Sn atoms and the percentage of 0 atoms calculated based on 100 atomic % of total Sn, P, Al, O, and Fe atoms present in the tin oxide layer 20 from the result of energy dispersive X-ray spectroscopy (EDS) performed on the tin oxide layer 20 using a transmission electron microscope.

The thickness of the tin oxide layer 20 is 8 to 20 nm, preferably 8 to 14 nm, more preferably 10 to 14 nm. According to the present embodiment, the surface-treated steel sheet 1 has the tin oxide layer 20, the composite oxide layer 30, and the aluminum-oxygen compound layer 40 formed in the stated order on the tin-plated steel sheet 10, and the thickness of the tin oxide layer 20 is within the above ranges. This imparts a good surface appearance to the surface-treated steel sheet 1 itself, and also enables the surface-treated steel sheet 1 to have excellent sulfide staining resistance and alkali resistance and have high adhesion to a coating layer. If the tin oxide layer 20 is too thin, the surface-treated steel sheet 1 has poor sulfide staining resistance, and thus has inferior product value. On the other hand, if the tin oxide layer 20 is too thick, the adhesion to a coating layer is reduced due to cohesive failure in the tin oxide layer.

Figure 2:
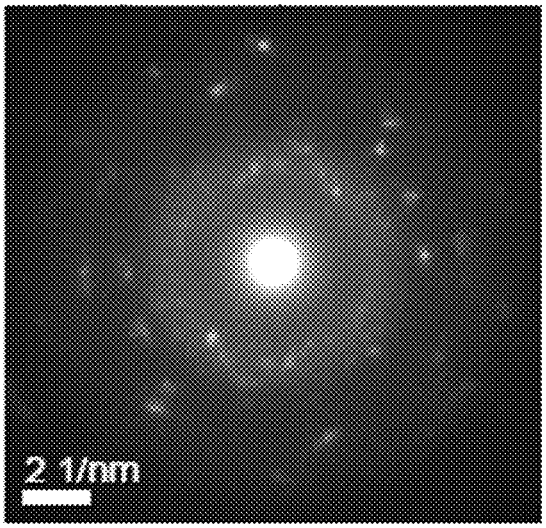
FIG. 2 is a view illustrating a diffraction pattern of a tin oxide layer 20 of Example 7 obtained by nano-beam electron diffraction using a transmission electron microscope.

Preferably, the tin oxide layer 20 shows a diffraction pattern arising from the crystalline structure of tin(IV) oxide ($SnO_2$) when the tin oxide layer 20 is subjected to diffraction pattern analysis by nano-beam electron diffraction using a transmission electron microscope. In other words, the tin oxide layer 20 preferably has the crystalline structure of tin(IV) oxide ($SnO_2$). FIG. 2 is a diffraction pattern of the tin oxide layer 20 of Example 7 (described later) obtained by nano-beam electron diffraction using a transmission electron microscope. As shown in FIG. 2, reflections arising from the (110), (020), (111), (120), and (121) planes originating from the crystalline structure of tin(IV) oxide ($SnO_2$) are observed for the tin oxide layer 20 of Example 7. In the present embodiment, to determine whether or not a layer shows a diffraction pattern arising from the crystalline structure of tin(IV) oxide ($SnO_2$), the following method may be used, for example: Diffraction pattern analysis by nano-beam electron diffraction is performed using a transmission electron microscope, and the resulting diffraction pattern is analyzed using an analysis program (product name "ReciPro", developed by Kobe University). When three or more crystal planes originating from the crystalline structure of tin(IV) oxide ($SnO_2$) are detected, it can be determined as showing a diffraction pattern arising from the crystalline structure of tin(IV) oxide ($SnO_2$).

In the present embodiment, the Sn atom content, the P atom content, and the Al atom content of the tin oxide layer 20 preferably fall in the following ranges based on 100 atomic % of total Sn, P, Al, O, and Fe atoms present in the tin oxide layer 20 from the result of energy dispersive X-ray spectroscopy (EDS) performed on the tin oxide layer 20 using a transmission electron microscope. Specifically, the Sn atom content is preferably 30 atomic % or more and less than 50 atomic %, more preferably 30 to 49 atomic %, still more preferably 40 to 47 atomic %, the P atom content is preferably 2 to 14 atomic %, more preferably 2 to 11 atomic %, and the Al atom content is preferably 3 to 15 atomic %, more preferably 3 to 12 atomic %. Control of the Sn atom content, the P atom content, and the Al atom content within the above ranges results in further enhanced sulfide staining resistance, alkali resistance, and adhesion to a coating layer. In the present embodiment, it is preferable that the Sn atom content, the P atom content, and the Al atom content in the entire tin oxide layer 20 be within the above ranges, and from the viewpoint of providing a higher enhancing effect on sulfide staining resistance, alkali resistance, and adhesion to a coating layer, it is more preferable that the Sn atom content, the P atom content, and the Al atom content in the region from the side facing the tin plating layer 12 to a depth of 8 nm or less be within the above ranges.

Although not specifically limited, the atomic ratio P/Al of P atoms to Al atoms in the tin oxide layer 20 is preferably 0.5 or more and less than 1.5, more preferably 0.6 to 1.4. Control of the atomic ratio P/Al of P atoms to Al atoms within the above ranges results in further enhanced sulfide staining resistance, alkali resistance, and adhesion to a coating layer. The atomic ratio P/Al of P atoms to Al atoms can be calculated using the P atom content and the Al atom content determined as described above.

<Composite Oxide Layer 30>

The composite oxide layer 30 is famed on the tin oxide layer 20, and contains phosphoric acid and aluminum as main components. The composite oxide layer 30 may be famed in direct contact with the tin oxide layer 20, or may be famed thereon with an interposing diffusion layer famed as a result of mutual diffusion of the composite oxide layer 30 and the tin oxide layer 20.

The composite oxide layer 30 may be any layer containing phosphoric acid and aluminum as main components. In the present embodiment, when the amount of tin plating is 5.6 to 11.2 g/m$^2$, the composite oxide layer 30 may be a layer having an Sn atom content of 10 atomic % or more, a P atom content of 7 atomic % or more, an Al atom content of less than 24 atomic %, and an O atom content of 48 atomic % or more. When the amount of tin plating is 1.3 g/m$^2$ or more and less than 5.6 g/m$^2$, the composite oxide layer 30 may be a layer having a Sn atom content of 9 atomic % or more, a P atom content of 4 atomic % or more, an Al atom content of 22 atomic % or more, and an O atom content of 40 atomic % or more. The P atom content, the Al atom content, and the O atom content can be determined based on 100 atomic % of total Sn, P, Al, O, and Fe atoms present in the tin oxide layer 20 from the result of energy dispersive X-ray spectroscopy (EDS) performed on the composite oxide layer 30 using a transmission electron microscope.

The thickness of the composite oxide layer 30 is preferably 1 to 10 nm, more preferably 3 to 5 nm. Control of the thickness of the composite oxide layer 30 within the above ranges results in further enhanced sulfide staining resistance, alkali resistance, and adhesion to a coating layer.

In the present embodiment, the Sn atom content, the P atom content, and the Al atom content of the composite oxide layer 30, which are determined in the same manner as for the tin oxide layer 20, preferably fall within the following ranges. Specifically, the Sn atom content is preferably less than 30 atomic %, more preferably 20 atomic % or less, the P atom content is preferably 25 atomic % or less, more preferably 21 atomic % or less, and the Al atom content is preferably 10 atomic % or more, more preferably 12 atomic % or more. Control of the Sn atom content, the P atom content, and the Al atom content within the above ranges results in further enhanced sulfide staining resistance, alkali resistance, and adhesion to a coating layer.

The atomic ratio P/Al of P atoms to Al atoms in the composite oxide layer 30 is not specifically limited. When the amount of tin plating is 5.6 to 11.2 g/m$^2$, the ratio is preferably 0.30 to 1.4, more preferably 0.38 to 1.35, still more preferably 0.41 to 1.28. When the amount of tin plating is 1.3 g/m$^2$ or more and less than 5.6 g/m$^2$, the atomic ratio P/Al of P atoms to Al atoms is preferably 0.10 to 0.40, more preferably 0.16 to 0.37, sill more preferably 0.20 to 0.30. Control of the atomic ratio P/Al of P atoms to Al atoms within the above ranges results in further enhanced sulfide staining resistance, alkali resistance, and adhesion to a coating layer. The atomic ratio P/Al of P atoms to Al atoms can be calculated using the P atom content and the Al atom content determined as described above.

<Aluminum-Oxygen Compound Layer 40>

The aluminum-oxygen compound layer 40 is a layer formed on the composite oxide layer 30 and containing an aluminum-oxygen compound as a main component. The aluminum-oxygen compound layer 40 may be famed in direct contact with the composite oxide layer 30, or may be foiled with an interposing diffusion layer formed as a result of mutual diffusion of the aluminum-oxygen compound layer 40 and the composite oxide layer 30. Examples of the aluminum-oxygen compound contained as a main component in the aluminum-oxygen compound layer 40 include, but are not specifically limited to, $Al_2O_3$, $Al(OH)_3$, and the like.

The aluminum-oxygen compound layer 40 may be any layer containing an aluminum-oxygen compound as a main component. In the present embodiment, when the amount of tin plating is 5.6 to 11.2 g/m$^2$, the aluminum-oxygen compound layer 40 may be a layer having a P atom content of less than 7 atomic %, an Al atom content of 24 atomic % or more, and an O atom content of 49 atomic % or more. When the amount of tin plating is 1.3 g/m$^2$ or more and less than 5.6 g/m$^2$, the aluminum-oxygen compound layer 40 may be a layer having a P atom content of less than 4 atomic %, an Al atom content of less than 22 atomic %, and an O atom content of 57 atomic % or more. The Al atom content and the O atom content can be determined based on 100 atomic % of total Sn, P, Al, O, and Fe atoms present in the tin oxide layer 20 from the result of energy dispersive X-ray spectroscopy (EDS) performed on the composite oxide layer 30 using a transmission electron microscope.

The thickness of the aluminum-oxygen compound layer 40 is preferably 2 to 5 nm, more preferably 3 to 4 nm. Control of the thickness of the aluminum-oxygen compound layer 40 within the above ranges results in further enhanced sulfide staining resistance, alkali resistance, and adhesion to a coating layer.

In the present embodiment, the Sn atom content, the P atom content, and the Al atom content of the aluminum-oxygen compound layer 40, which are determined in the same manner as for the tin oxide layer 20, preferably fall within the following ranges. Specifically, the Sn atom content is preferably 3 to 20 atomic %, the P atom content is preferably 1 atomic % or more, and the Al atom content is preferably 10 atomic % or more, more preferably 16 atomic % or more. The P atom content of the aluminum-oxygen compound layer 40 is smaller than that of the composite oxide layer 30. Control of the Sn atom content, the P atom content, and the Al atom content within the above ranges results in further enhanced sulfide staining resistance, alkali resistance, and adhesion to a coating layer.

Although not specifically limited, the atomic ratio P/Al of P atoms to Al atoms in the aluminum-oxygen compound layer 40 is preferably 0.02 to 0.05. When the amount of tin plating is 5.6 to 11.2 g/m$^2$, the ratio is preferably 0.04 to 0.40, more preferably 0.05 to 0.29, still more preferably 0.05 to 0.25. When the amount of tin plating is 1.3 g/m$^2$ or more and less than 5.6 g/m$^2$, the atomic ratio P/Al of P atoms to Al atoms is preferably 0.02 to 0.20, more preferably 0.04 to 0.18, sill more preferably 0.05 to 0.15. Control of the atomic ratio P/Al of P atoms to Al atoms within the above ranges results in further enhanced sulfide staining resistance, alkali resistance, and adhesion to a coating layer. The atomic ratio P/Al of P atoms to Al atoms can be calculated using the P atom content and the Al atom content determined as described above. Although the atomic ratio P/Al of P atoms to Al atoms in the aluminum-oxygen compound layer 40 is preferably within the above ranges, the atomic ratio P/Al of the aluminum-oxygen compound layer 40 is typically smaller than the atomic ratio P/Al of the composite oxide layer 30.

In the surface-treated steel sheet 1 according to the present embodiment, the amount of tin (Sn) deposited (the amount of tin deposited on one side in the case where the tin plating layer 12, the tin oxide layer 20, the composite oxide layer 30, and the aluminum-oxygen compound layer 40 are famed on each of both sides) is preferably 1.3 g/m$^2$ or more, more preferably 2.8 to 11.2 g/m$^2$, still more preferably 5.6 to 11.2 g/m$^2$. When the amount of tin deposited is controlled to 5.6 g/m$^2$ or more, the adhesion to a coating layer can be further increased by selecting conditions for electrolytic treatment using an electrolytic treatment solution containing phosphate ions. The amount of tin deposited can be controlled, for example, by controlling the amount of tin plating in the process of tin plating on the steel sheet 11 to faun the tin-plated steel sheet 10.

By performing a reflow treatment on the tin-plated steel sheet, a tin-iron alloy layer is formed between the steel sheet 11 and the tin plating layer 12. When the amount of tin deposited is less than 5.6 g/m$^2$, the amount of tin in the tin plating layer on the tin-iron alloy layer after the reflow treatment is small, which indicates that the tin-iron alloy layer is present closer to the tin oxide layer. Moreover, when the amount of tin deposited is less than 5.6 g/m$^2$, it is presumed that minute projections and recesses are present on the tin oxide layer, the tin plating layer, and the tin-iron alloy layer after the reflow treatment, and the tin oxide layer is only partially thin. If a steel sheet having such a structure is subjected to the electrolytic treatments in the second and third steps (described later), it is presumed that electricity does not flow uniformly on the outermost surface (concentrates on some portions). In contrast, when the amount of tin deposited is 5.6 g/m$^2$ or more, the amount of tin under the tin oxide layer after the reflow treatment is large, which indicates that the tin-iron alloy layer is located farther from the tin oxide layer. Moreover, it is presumed that fewer projections and recesses are present on the tin oxide layer, the tin plating layer, and the tin-iron alloy layer after the reflow treatment compared to the case where the amount of tin deposited is less than 5.6 g/m$^2$. If a steel sheet having such a structure is subjected to the electrolytic treatments in the second and third steps (described later), it is presumed that electricity flows uniformly on the outermost surface. Presumably, the difference in surface condition due to the amount of tin deposited affects deposition of a composite oxide phosphoric acid treatment layer famed in the second step and the P and Al component distributions in an aluminum-oxygen compound layer coating famed in the third step.

<Method for Manufacturing Surface-Treated Steel Sheet 1>

The surface-treated steel sheet 1 according to the present invention may be manufactured by any method without limitation, and one example thereof is a method comprising:

- a first step of providing a tin-plated steel sheet 10 having a tin plating on a steel sheet 11;
- a second step of subjecting the tin-plated steel sheet 10 to an electrolytic treatment in an electrolytic treatment solution containing phosphate ions with 0.1 C/dm$^2$ or more and 1.0 C/dm$^2$ or less of electricity; and
- a third step of subjecting the tin-plated steel sheet 10 subjected to the electrolytic treatment in the second step to a cathode electrolytic treatment in an electrolytic treatment solution containing aluminum ions.

<First Step>

The first step of the manufacturing method is a step of providing a tin-plated steel sheet 10 having a tin plating on a steel sheet 11.

The steel sheet 11 to be plated with tin is any steel sheet having excellent workability in drawing, workability in drawing and ironing, or workability in working (DTR) by drawing and unbending, and is not specifically limited. For example, a hot rolled steel sheet including an aluminum-killed steel continuous cast material as a base, a cold rolled steel sheet obtained by cold rolling of such a hot rolled steel sheet, or the like may be used. Alternatively, the steel sheet 11 to be plated with tin may be a nickel-plated steel sheet having enhanced corrosion resistance imparted by forming a nickel plating layer on any of the above-mentioned steel sheets and heating the resulting steel sheet to cause thermal diffusion and thereby form a nickel-iron alloy layer between the steel sheet and the nickel plating layer. In this case, when the nickel plating layer is formed as a layer of granules, due to an anchoring effect, the adhesion to a coating layer famed from an organic material on the aluminum-oxygen compound layer 40 can be further increased.

Examples of methods for tin-plating the steel sheet 11 include, but are not specifically limited to, methods such as using a known plating bath such as a ferrostan bath, a halogen bath, and a sulfuric acid bath. Examples of nickel-plating methods include, but are also not specifically limited to, using a known Watt bath including nickel sulfate and nickel chloride. In order to form the nickel plating layer as a layer of granules, a bath composition including nickel sulfate and ammonium sulfate is preferably used. Furthermore, in the present embodiment, the tin-plated steel sheet 10 obtained through tin plating as described above may be subjected to a treatment including heating the tin-plated steel sheet to a temperature equal to or higher than a melting temperature of tin followed by rapid cooling (reflow treatment) to form a tin-iron alloy layer between the steel sheet 11 and the tin-plating layer 12. In the present embodiment, as a result of such a reflow treatment, the resulting tin-plated steel sheet 10 comprises the tin-iron alloy layer and the tin-plating layer 12 formed in the stated order on the steel sheet 11, which results in enhanced corrosion resistance. In the case where an underlying nickel plating layer is present, such a reflow treatment may form a tin-nickel alloy and a tin-nickel-iron alloy between the steel sheet 11 and the tin-plating layer 12.

Additionally, a tin oxide layer **20*a* containing tin oxide as a main component is typically famed on a surface of the tin-plated steel sheet 10. The tin oxide layer 20*a* formed has the crystalline structure of tin(IV) oxide ($SnO_2$) (shows a diffraction pattern arising from the crystalline structure of tin(IV) oxide ($SnO_2$)). According to the present embodiment, the reflow treatment described above promotes the formation of the tin oxide layer 20*a***.

Although before a post-treatment after the reflow treatment, an electrolytic treatment called "cleaning treatment", which involves cathode electrolysis and anode electrolysis using an acid or an alkali, or an electrolytic treatment including a combination of cathode and anode electrolysis using an acid or an alkali, is typically performed to remove the tin oxide layer **20*a*** famed on the tin-plated surface, such a treatment may or may not be performed.

<Second Step>

The second step of the manufacturing method is a step of subjecting the tin-plated steel sheet 10 provided in the first step to an electrolytic treatment in an electrolytic treatment solution containing phosphate ions with 0.1 $C/dm^2$ or more and 1.0 $C/dm^2$ or less of electricity.

The electrolytic treatment solution containing phosphate ions may contain any phosphoric acid compound without limitation. Examples of usable compounds include phosphoric acid ($H_3PO_4$) and phosphoric acid salts such as sodium dihydrogen phosphate ($NaH_2PO_4$), disodium hydrogen phosphate ($Na_2HPO_4$), and phosphorous acid ($H_3PO_3$). The phosphoric acid and phosphoric acid salts may be used alone or in a mixture. In particular, a mixture of phosphoric acid and sodium dihydrogen phosphate is suitable.

The content of phosphate ions in the electrolytic treatment solution is not specifically limited, and is preferably 5 to 15 g/L, more preferably 10 to 13 g/L on a phosphorus basis. The pH of the electrolytic treatment solution is also not specifically limited, and is preferably 1 to 7, more preferably 2 to 4.

The amount of electricity in the electrolytic treatment is 0.1 $C/dm^2$ or more and 1.0 $C/dm^2$ or less, preferably 0.3 to 0.7 $C/dm^2$. Using too little electricity in the electrolytic treatment results in insufficient formation of the composite oxide layer 30, which leads to poor sulfide staining resistance, alkali resistance, and adhesion to a coating layer. On the other hand, using too much electricity in the electrolytic treatment preferentially causes dissolution on the surface of the metal tin layer ($Sn \rightarrow Sn^{2+} + 2e^-$) during anode electrolysis. As a result of tin dissolution, the smoothness of the surface famed by the reflow treatment is lost, which is great damage to a glossy appearance characteristic of tinplate. The amount of electricity in the electrolytic treatment may be controlled by selecting the current density during the electrolytic treatment and the treatment time. The current density is preferably selected from the range of 0.1 to 1.5/$dm^2$, and the treatment time is preferably selected from the range of 0.1 to 2.0 seconds.

Although the electrolytic treatment may be either a cathode electrolytic treatment or an anode electrolytic treatment, a preferable treatment includes performing a cathode electrolytic treatment and then performing an anode electrolytic treatment, or includes performing an anode electrolytic treatment and then performing a cathode electrolytic treatment. In particular, a treatment including performing a cathode electrolytic treatment and then performing an anode electrolytic treatment is preferable. In this case, the amount of electricity in the cathode electrolytic treatment is 0.05 $C/dm^2$ or more and 0.5 $C/dm^2$ or less, preferably 0.1 to 0.4 $C/dm^2$. The amount of electricity in the anode electrolytic treatment is 0.05 $C/dm^2$ or more and 0.5 $C/dm^2$ or less, preferably 0.1 to 0.4 $C/dm^2$. The ratio between the amount of electricity in the cathode electrolytic treatment and the amount of electricity in the anode electrolytic treatment is not specifically limited, and the amount of electricity in cathode electrolytic treatment-to-amount of electricity in anode electrolytic treatment ratio is preferably 1:2 to 2:1. More preferably, the amount of electricity in the cathode electrolytic treatment is substantially equal to the amount of electricity in the anode electrolytic treatment.

In the cathode electrolytic treatment on the tin-plated steel sheet 10, any counter electrode plate for the tin-plated steel sheet 10 may be used as long as it does not dissolve in the electrolytic treatment solution during the electrolytic treatment. An iridium oxide-coated titanium sheet or a platinum-coated titanium sheet is preferably used because they are unlikely to dissolve in the electrolytic treatment solution.

In the present embodiment, the electrolytic treatment using the electrolytic treatment solution containing phosphate ions generates tin ions $Sn^{2+}$ from the tin-plated steel sheet 10, and then the tin ions receive electrons during the electrolytic treatment, resulting in precipitation of a coating containing tin as a main component on the surface. Additionally, although the amount is small, tin ions $Sn^{2+}$ generated from the tin-plated steel sheet 10 react with phosphate ions $PO_4^{3-}$ in the electrolytic treatment solution, resulting in precipitation of tin phosphate such as $Sn_3(PO_4)_2$ on the tin-plated steel sheet 10. Tin ions $Sn^{2+}$ generated from the tin-plated steel sheet 10 are also precipitated as tin oxide ($SnO_x$) on the tin-plated steel sheet 10.

<Third Step>

The third step of the manufacturing method is a step of subjecting the tin-plated steel sheet 10 subjected to the electrolytic treatment in the second step to a cathode electrolytic treatment in an electrolytic treatment solution containing aluminum ions.

The content of aluminum ions contained in the electrolytic treatment solution containing aluminum ions is preferably 0.5 to 10 g/L, more preferably 1 to 5 g/L in terms of the mass concentration of aluminum ions. Control of the content of aluminum ions in the electrolytic treatment solution within the above ranges enhances the stability of the electrolytic treatment solution and also enhances the precipitation efficiency of the aluminum-oxygen compound.

Figure 3A:
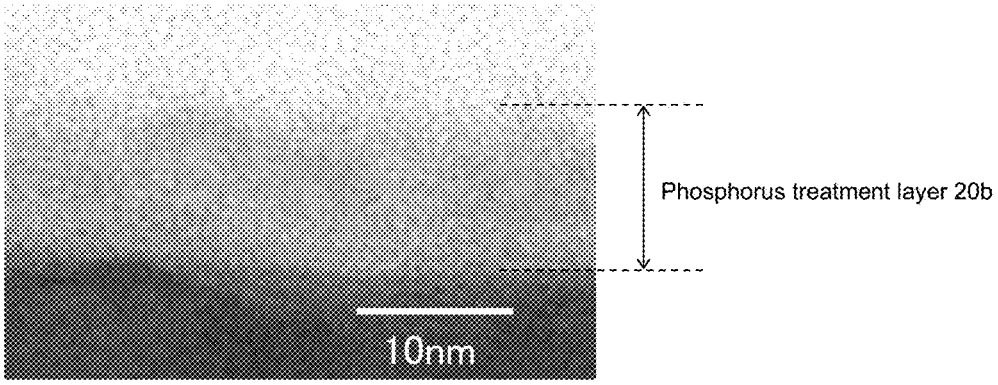
FIG. 3A is a TEM photograph of a cross section of a surface-treated steel sheet of Comparative Example 4.
Figure 3B:
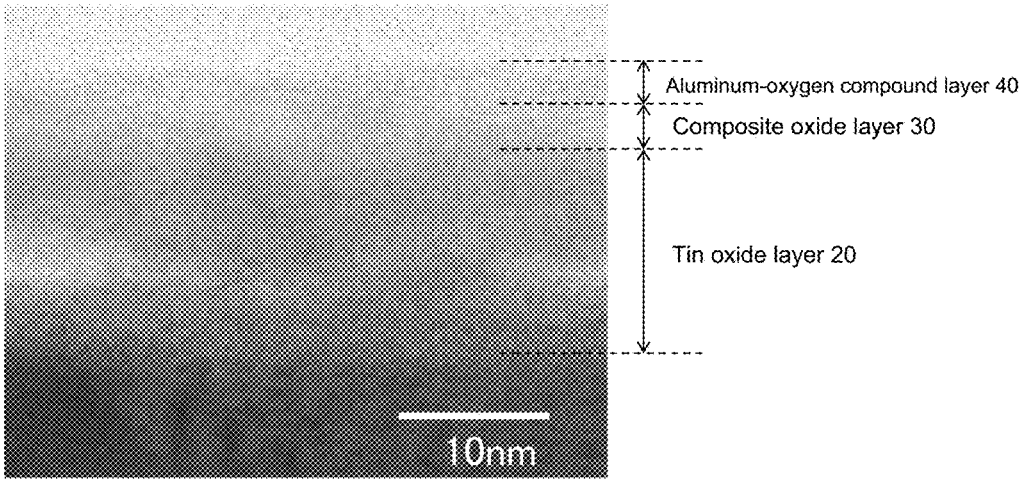
FIG. 3B is a TEM photograph of a cross section of a surface-treated steel sheet of Example 2.

According to the present embodiment, by performing the electrolytic treatment in the electrolytic treatment solution containing phosphate ions using a specific amount of electricity, which is relatively low, in the second step described above, the tin oxide layer 20*a* formed on the surface of the tin-plated steel sheet 10 is converted into an amorphous phosphorus treatment layer 20*b* containing tin and phosphorus as main components and having an O atom content of 10 atomic % or less. According to the present embodiment, the cathode electrolytic treatment using an electrolytic treatment solution containing aluminum ions is performed in the third step, and due to the effect of the cathode electrolytic treatment, a chemical reaction is induced in the phosphoric acid treatment layer 20*b* formed in the second step, so that the tin oxide layer 20 containing tin oxide as a main component is formed. Moreover, the third step results in formation of the composite oxide layer 30 and the aluminum-oxygen compound layer 40 thereon. Furthermore, through the third step, the tin oxide layer 20 formed from the amorphous phosphorus treatment layer 20*b* can be formed as a layer having the crystalline structure of tin (IV) oxide ($SnO_2$) (showing a diffraction pattern arising from the crystalline structure of tin (IV) oxide ($SnO_2$)). FIG. 3A shows a TEM photograph of a cross section of a surface-treated steel sheet of Comparative Example 4, and FIG. 3B shows a TEM photograph of a cross section of a surface-treated steel sheet of Example 2. FIG. 3A is a TEM photograph of a cross section corresponding to that after the second step (in Comparative Example 4, the third step was not performed after the second step), and FIG. 3B is a TEM photograph of a cross section after the third step.

To the electrolytic treatment solution containing aluminum ions used in the third step may be added nitrate ions. In the case where nitrate ions are added to the electrolytic treatment solution containing aluminum ions, the content of nitrate ions in the electrolytic treatment solution is preferably 11,500 to 25,000 ppm by weight. Control of the content of nitrate ions within the above range results in control of the conductivity of the electrolytic treatment solution within a suitable range.

The electrolytic treatment solution containing aluminum ions used in the third step may also contain at least one of additives such as organic acids (such as citric acid, lactic acid, tartaric acid, and glycolic acid), polyacrylic acid, polyitaconic acid, and phenolic resins. As a result of appropriately adding any one or a combination of these additives to the electrolytic treatment solution, the resulting aluminum-oxygen compound layer 40 contains an organic material. Consequently, when a coating layer famed from an organic material is famed on the aluminum-oxygen compound layer 40, further enhanced adhesion to the coating layer can be ensured.

The amount of electricity in the cathode electrolytic treatment in the third step is preferably 3 to 10 C/dm$^2$, more preferably 5 to 8 C/dm$^2$. Control of the amount of electricity in the cathode electrolytic treatment within the above ranges results in further enhanced sulfide staining resistance, adhesion to a coating layer, and corrosion resistance. The cathode electrolytic treatment in the third step may be an intermittent electrolysis mode in which a cycle of energization and stop of energization is repeated.

After the cathode electrolytic treatment in the third step, a treatment such as washing with water is performed as needed. Thus, the surface-treated steel sheet 1 can be obtained.

<Metal Container>

Although not specifically limited, the surface-treated steel sheet 1 according to the present invention can be used as a can container member, a can lid member, or the like. When the surface-treated steel sheet 1 is used as a can container member, a can lid member, or the like, the surface-treated steel sheet 1 may be used as it is (as a paintless sheet without a coating layer on the surface) and shaped into a paintless can container or can lid, or may be shaped into a can container, a can lid, or the like after a coating layer famed from an organic material is famed on the aluminum-oxygen compound layer 40 of the surface-treated steel sheet 1. The organic material for forming the coating material is not specifically limited. Although an appropriate material can be selected according to the intended use of the surface-treated steel sheet 1 (for example, use as a can to be filled with a specific content), either a thermoplastic resin or a thermosetting resin can be used.

Examples of thermosetting resins include films of olefinic resins such as polyethylene, polypropylene, ethylene-propylene copolymers, ethylene-vinyl acetate copolymers, ethylene-acryl ester copolymers, and ionomers, polyester films such as those of polyethylene terephthalate and polybutylene terephthalate, unstretched films and biaxially oriented films such as polyvinyl chloride films and polyvinylidene chloride films, polyamide films such as those of nylon 6, nylon 6,6, nylon 11, and nylon 12, and the like. Among these, unoriented polyethylene terephthalate prepared by copolymerization with isophtalic acid is particularly preferred. These organic materials for forming the coating layer may be used alone or may be blended with a different organic material.

Examples of usable thermosetting resins include epoxy-phenolic resins, polyester resins, and the like.

In the case where a coating of a thermoplastic resin is famed as a coating layer, the layer may be a single resin layer or may be a multi-layered resin layer famed by coextrusion or the like. Forming a multi-layered polyester resin layer is advantageous because this allows selection of a polyester resin having a composition excellent in adhesion properties for an underlying layer, that is, a layer closest to the surface-treated steel sheet 1, and selection of a polyester resin having a composition excellent in resistance to container contents, that is, resistance to extraction and flavor component non-adsorptive properties for a surface layer.

Examples of such a multi-layered polyester resin layer include, but are obviously not limited to, polyethylene terephthalate/polyethylene terephthalate•isophthalate, polyethylene terephthalate/polyethylenecyclohexylene dimethylene•terephthalate, polyethylene terephthalate•isophthalate having a low isophthalate content/polyethylene terephthalate•isophthalate having a high isophthalate content, and polyethylene terephthalate•isophthalate/[a blended product of polyethylene terephthalate•isophthalate and polybuthylene terephthalate•adipate], which are shown as surface layer/lower layer. The thickness ratio of the surface layer to the lower layer is desirably in the range of 5:95 to 95:5.

The coating layer may contain compounding agents for resins known per se, such as an antiblocking agent such as amorphous silica, an inorganic filler, various antistatic agents, a lubricant, an antioxidant (such as tocopherol), and an ultraviolet absorber in accordance with known formulations.

In the case of coating with a thermoplastic resin, the thickness of the coating layer is preferably in the range of 3 to 50 μm, more preferably the range of 5 to 40 μm. In the case of a coating film, its thickness after baking is preferably in the range of 1 to 50 μm, more preferably the range of 3 to 30 μm. Control of the thickness of the coating layer within the above ranges results in excellent corrosion resistance as well as sufficient processability.

The coating layer can be famed on the surface-treated steel sheet 1 by any means. In the case of coating with a thermoplastic resin, extrusion coating, casted film thermal adhesion, biaxially stretched film thermal bonding, or the like can be used.

Thermal bonding of a polyester resin to the surface-treated steel sheet 1 uses heat energy possessed by the molten-resin layer and heat energy possessed by the surface-treated steel sheet 1. The heating temperature of the surface-treated steel sheet 1 is preferably 90° C. to 290° C., more preferably 100° C. to 230° C., whereas the temperature of the laminating rolls is preferably in the range of 10° C. to 150° C.

Alternatively, the coating layer can also be formed on the surface-treated steel sheet 1 by thermally bonding a polyester resin film made in advance by the T-die method or inflation film formation to the surface-treated steel sheet 1. The film to be used may be an unstretched film prepared by cast molding in which an extruded film is immediately cooled, or may be a biaxially-stretched film obtained by biaxially stretching this film at a stretching temperature either successively or simultaneously, and thermally fixing the film after stretching.

Figure 4A:
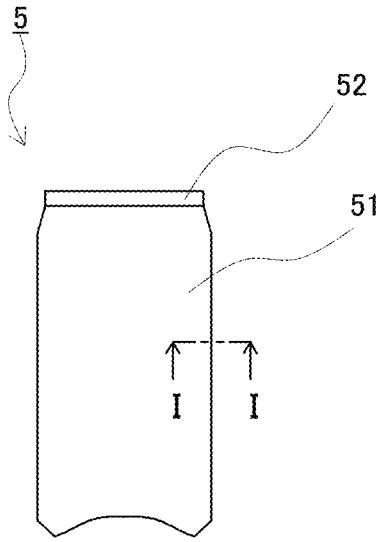
FIGS. 4A and 4B are views each illustrating one example of a metal container formed using the surface-treated steel sheet according to the embodiment of the present invention.
Figure 4B:
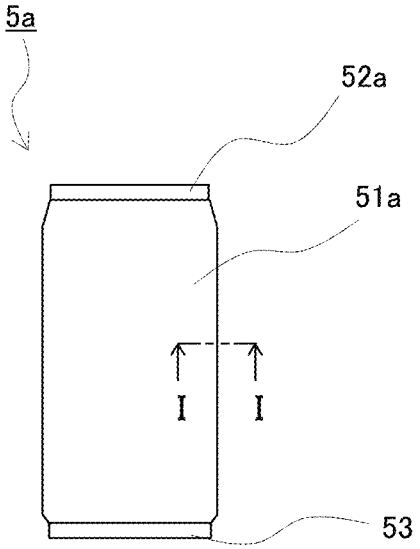

For example, after the coating layer is formed on the surface of the surface-treated steel sheet 1 according to the present embodiment to obtain an organic material-coated steel sheet, the resulting steel sheet can be processed and shaped into a can container. Examples of such a can container include, but are not specifically limited to, a seamless can 5 (two-piece can) shown in FIG. 4A and a three-piece can 5*a* (welded can) shown in FIG. 4B. A body 51 and an upper lid 52 constituting the seamless can 5 and a body 51*a*, an upper lid 52*a*, and a lower lid 53 constituting the three-piece can 5*a* are all formed using the organic material-coated steel sheet obtained by forming the coating layer on the surface-treated steel sheet 1 according to the present embodiment. Regarding FIGS. 4A and 4B, each of the seamless can 5 and the three-piece can 5*a* has a cross section in which, as a result of rotation by 90°, the coating layer is located inside the can. The cans 5 and 5*a* respectively shown in FIGS. 4A and 4B can be produced by any conventionally known means, such as drawing processing, drawing/redrawing processing, stretching processing via drawing/redrawing, stretching/ironing processing via drawing/redrawing, or drawing/ironing processing, such that the coating layer is located inside the can.

The seamless can 5, which is subjected to a highly sophisticated process, such as stretching process via drawing/redrawing and stretching/ironing process via drawing/redrawing, preferably has a coating layer obtained by coating with a thermoplastic resin by extrusion coating. That is, such an organic material-coated steel sheet has excellent adhesion during processing, and therefore has excellent coating adhesion even after subjected to severe processing, and can provide a seamless can having excellent corrosion resistance.

As described above, a can lid can be produced, for example, by forming the coating layer on the surface of the surface-treated steel sheet 1 according to the present embodiment to obtain an organic material-coated steel sheet as described above, and processing the resulting sheet. Examples of such a can lid include, but are not specifically limited to, flat lids, stay-on-tub type easy-open can lids, full-open type easy-open can lids, and the like.

EXAMPLES

Hereinafter, the present invention will be specifically described with reference to examples, but the present invention should not be construed as limited to these examples.

The properties were evaluated by the following methods.

<Analysis of Electrolytic Treatment Solution>

Electrolytic treatment solutions were measured for the concentration of phosphate ions or the concentration of Al ions using an ICP emission spectrometer (available from SHIMADZU CORPORATION, ICPE-9000), and were measured for the concentration of nitrate ions using an ion chromatograph (available from Dionex Corporation, DX-500). The pH of each electrolytic treatment solution was also measured using a pH meter (available from HORIBA, Ltd.).

<Contents of Atoms in Tin Oxide Layer 20, Composite Oxide Layer 30, and Aluminum-Oxygen Compound Layer 40>

The tin oxide layer 20, the composite oxide layer 30, and the aluminum-oxygen compound layer 40 of each of surface-treated steel sheets were each subjected to carbon deposition, and then carbon was further deposited to a thickness of about 1 μm in an FIB apparatus. A sample was cut out by microsampling, and fixed on a copper support. Thereafter, a cross-sectional TEM specimen was prepared by FIB processing, and quantitatively analyzed by TEM observation using a transmission electron microscope and by EDS analysis. Specifically, the contents of atoms (Sn atoms, P atoms, and Al atoms) were determined for each of the tin oxide layer 20, the composite oxide layer 30, and the aluminum-oxygen compound layer 40 based on 100 atomic % of total Sn, P, Al, O, and Fe atoms. To determine the contents of the atoms in the tin oxide layers 20, a point at 5 nm from the surface of the tin plating layer 12 toward the surface was measured. To determine the contents of the atoms in the composite oxide layer 30, a point at a depth of 7 nm from the outermost surface of the surface-treated steel sheet was measured. To determine the contents of the atoms in the aluminum-oxygen compound layer 40, a point at a depth of 2 nm from the outermost surface of the surface-treated steel sheet was measured. The Fe contents of all the examples and the comparative examples were as low as 1 to 10 atomic %. Based on this fact, the O atom content was determined as the remainder excluding the Sn atom content, the P atom content, and the Al atom content and including the trace Fe content.

FIB: FB-2000C focused ion beam system, available from Hitachi, Ltd., acceleration voltage 40 kV TEM: JEM-2010F field-emission transmission electron microscope, available from JEOL Ltd., acceleration voltage: 200 kV EDS: UTW Si (Li) semiconductor detector, available from Nolan Instruments Co., Ltd., analysis range: 1 nm <Thickness of Tin Oxide Layer 20>

A cross-sectional TEM specimen was prepared in the same manner as in the measurement of the contents of atoms described above. The cross-sectional TEM specimen prepared was quantitively analyzed sequentially from the location where the tin plating layer 12 was formed toward the surface by TEM observation and energy dispersive X-ray spectroscopy (EDS) to determine the thickness of the tin oxide layer 20. Specifically, the range where the Sn atom content was 30 atomic % or more and the O atom content was 30 atomic % or more was regarded as the tin oxide layer 20, and the thickness thereof was regarded as the thickness of the tin oxide layer 20.

<Crystalline Structure of Tin(IV) Oxide ($SnO_2$) in Tin Oxide Layer 20>

A cross-sectional TEM specimen was prepared in the same manner as in the measurement of the contents of atoms described above. The cross-sectional TEM specimen prepared was subjected to diffraction pattern analysis by nanobeam electron diffraction using a transmission electron microscope (JEM-2010F field-emission transmission electron microscope, available from JEOL Ltd., acceleration voltage: 200 kV). The resulting diffraction pattern was analyzed using an analysis program (product name "ReciPro", developed by Kobe University) to determine the presence or absence of the crystalline structure of tin(IV) oxide ($SnO_2$). Specifically, samples from which three or more crystal planes originating from the crystalline structure of tin(IV) oxide ($SnO_2$) were detected were regarded as having the crystalline structure of tin(IV) oxide ($SnO_2$).

<Surface Appearance Evaluation>

The surface of each surface-treated steel sheet 1 was visually observed and evaluated for surface appearance based on the following criteria. A better surface appearance is preferable because it reflects better product quality. In the surface appearance evaluation, steel sheets scored as B and A based on the following criteria were regarded as having a sufficient surface appearance as a product for various applications.

A: Visual observation found no difference in external appearance from a conventional example (Comparative Example 3).

B: Visual observation found that the gloss of the surface was slightly poor compared to the conventional example (Comparative Example 3).

C: Visual observation found poorer gloss compared to the conventional example (Comparative Example 3) and a well-defined crystal particle pattern of tin.

<Evaluation of Alkali Resistance>

Each of surface-treated steel sheets 1 was immersed in a 4% by weight aqueous NaOH solution as an alkaline aqueous solution at 40° C. for 15 seconds, and the surface of the surface-treated steel sheet 1 after immersion was visually observed to evaluate its alkali resistance based on the following criteria. Specifically, the residual amount of P was calculated in teams of % by weight from the amounts of Sn and P coatings measured after immersion using an X-ray fluorescence analyzer (available from Rigaku Corporation, ZSX 100e). Since Al dissolved within several seconds after immersion in the alkaline aqueous solution, the amount of Al could not be used as a reference for determination. For this reason, in this evaluation, only the amount of P was used as a reference for determination. If a coating layer is formed on a surface of a surface-treated steel sheet 1 having poor alkali resistance, the coating layer undesirably easily dissolves. In the alkali resistance evaluation, surface-treated steel sheets 1 scored as 3 or more based on the following criteria were evaluated as having sufficient alkali resistance for use in food/beverage can applications.

Score 5: The calculated amount of residual P is more than 40% by weight.

Score 4: The calculated amount of residual P is more than 30% by weight and less than 40% by weight.

Score 3: The calculated amount of residual P is more than 20% by weight and less than 30% by weight.

Score 2: The calculated amount of residual P is more than 0% by weight and 20% by weight or less, and the amount of Sn is also reduced.

Score 1: The calculated amount of residual P is 0% by weight and the amount of Sn is also reduced.

<Coating Adhesion Evaluation>

On each of surface-treated steel sheets 1, a coating layer was famed to provide an organic material-coated steel sheet, which was then subjected to a retort treatment at 125° C. for 30 minutes. A grid with a spacing of 5 mm and a depth reaching the steel sheet 11 was famed, and the coating layer was peeled off with a tape. The degree of peeling was visually observed and evaluated based on the following criteria. In the coating adhesion evaluation, surface-treated steel sheets 1 scored as 3 or more based on the following criteria were regarded as having sufficient adhesion to the coating layer for use in beverage/food can applications.

Score 5: Visual observation confirmed no peeling of the coating.

Score 4: Visual observation confirmed peeling of the coating at an area ratio of 20% or less.

Score 3: Visual observation confirmed peeling of the coating at an area ratio of more than 20% and 50% or less.

Score 2: Visual observation confirmed peeling of the coating at an area ratio of more than 50% and 80% or less.

Score 1: Visual observation confirmed peeling of the coating at an area ratio of more than 80%.

<Evaluation of Sulfide Staining Resistance (Model Solution)>

On each of surface-treated steel sheets 1, a coating layer was famed to provide an organic material-coated steel sheet, which was then cut into a 40-nm square piece. Subsequently, the cut surface was protected with a 3-nm wide tape to provide a test piece. Next, the test piece thus prepared was placed in a metal container made of stainless steel, and a model solution described below was poured thereinto such that the entire test piece was immersed in the model solution, followed by the retort treatment at 125° C. for 4 hours.

Model solution: aqueous solution containing 3.0 g/l of sodium dihydrogen phosphate ($NaH_2PO_4$), 7.1 g/L of disodium hydrogen phosphate ($Na_2HPO_4$), and 6 g/L of L-cysteine hydrochloride monohydrate having a pH of 7.0

Thereafter, the test piece was taken out, and the degree of sulfide staining was visually observed and evaluated based on the following criteria. In the evaluation of sulfide staining resistance (model solution), surface-treated steel sheets 1 scored as 3 or more based on the following criteria were regarded as having sufficient sulfide staining resistance for use in beverage/food can applications.

Score 5: Visual observation confirmed no sulfide staining.

Score 4: Visual observation confirmed sulfide staining at an area ratio of 20% or less.

Score 3: Visual observation confirmed sulfide staining at an area ratio of more than 20% and 50% or less.

Score 2: Visual observation confirmed sulfide staining at an area ratio of more than 50% and 80% or less.

Score 1: Visual observation confirmed sulfide staining at an area ratio of more than 80%.

Example 1

First, a low carbon cold-rolled sheet (thickness: 0.225 mm) was provided as a steel sheet 11.

Subsequently, the steel sheet 11 provided was degreased by a cathode electrolytic treatment using an aqueous solution of an alkaline degreasing agent (available from Nippon Quaker Chemical, Ltd., Formula 618-TK2) at 60° C. for 10 seconds. After washed with tap water, the steel sheet degreased was acid pickled by immersion in an acid pickling agent (a 5% by volume aqueous sulfuric acid solution) at normal temperature for 5 seconds, followed by washing with tap water. The steel sheet was tin-plated using a known ferrostan bath under the following conditions to form tin plating layers 12 each containing 8.4 g/m$^2$ of tin (amount of tin on each side) on both sides of the steel sheet. The steel sheet having the tin-plating layers 12 was then washed with water, and energized with direct current to generate heat. The steel sheet was subjected to a reflow treatment in which the steel sheet was heated to a temperature equal to or higher than the melting point of tin, and then rapidly cooled by sprinkling tap water thereon. Thus, a tin-plated steel sheet 10 was famed.

Bath temperature: 40° C.

Current density: 10 A/dm$^2$

Anode material: commercially available 99.999% metal tin

Total energizing time: 16 seconds

Subsequently, the tin-plated steel sheet 10 obtained was immersed in an electrolytic treatment solution containing phosphate ions, and subjected to a cathode electrolytic treatment therein under the following conditions using an iridium oxide-coated titanium plate placed at an interelectrode distance of 17 mm as an anode while the electrolytic treatment solution was being stirred. This was followed by an anode electrolytic treatment in which the energizing direction was reversed.

Composition of electrolytic treatment solution: aqueous solution containing 10 g/L of phosphoric acid and 30 g/L of disodium hydrogen phosphate dissolved therein pH of electrolytic treatment solution: 2.5

Temperature of electrolytic treatment solution: 40° C.

Amount of electricity in cathode electrolytic treatment: 0.15 C/dm$^2$

Amount of electricity in anode electrolytic treatment: 0.15 C/dm$^2$

Next, the tin-plated steel sheet 10 subjected to the cathode electrolytic treatment and the anode electrolytic treatment in the electrolytic treatment solution containing phosphate ions was washed with water, immersed in an electrolytic treatment solution containing aluminum ions, and subjected to a cathode electrolytic treatment therein under the following conditions using an iridium oxide-coated titanium plate placed at an interelectrode distance of 17 mm as an anode while the electrolytic treatment solution was being stirred. After the treatment, the steel sheet was immediately washed with running water and dried to provide a surface-treated steel sheet 1 having a tin oxide layer 20, a composite oxide layer 30, and an aluminum-oxygen compound layer 40 formed in the stated order on the tin-plated steel sheet 10. The tin oxide layer 20, the composite oxide layer 30, and the aluminum-oxygen compound layer 40 formed on the tin-plated steel sheet 10 were substantially chromium-free.

Composition of electrolytic treatment solution: aqueous solution prepared by dissolving aluminum nitrate as an aluminum compound and having an aluminum concentration of 1,500 ppm by weight, a nitrate ion concentration of 15,000 ppm by weight, and a fluoride ion concentration of 0 ppm by weight pH of electrolytic treatment solution: 3.0

Temperature of electrolytic treatment solution: 40° C.

Amount of electricity in electrolytic treatment: 7.5 C/dm$^2$

The surface-treated steel sheet 1 obtained was measured for the contents of atoms in each of the tin oxide layer 20, the composite oxide layer 30, and the aluminum-oxygen compound layer 40, the thickness of the tin oxide layer 20, and the crystalline structure of tin(IV) oxide ($SnO_2$) in the tin oxide layer 20, and was evaluated by the surface appearance evaluation and the alkali resistance evaluation. The results are shown in Table 1.

Next, the surface-treated steel sheet 1 was subjected to a thermal treatment at 190° C. for 10 minutes, and was coated with an epoxy phenolic paint to provide a coating having a thickness after baking and drying of 70 mg/dm$^2$. Through baking at 200° C. for 10 minutes, an organic material-coated steel sheet having a coating layer on the surface-treated steel sheet 1 was obtained. Thereafter, the organic material-coated steel sheet obtained was evaluated by the coating adhesion evaluation and the sulfide staining resistance evaluation (model solution) in accordance with the methods described above. The results are shown in Table 1.

Example 2

A surface-treated steel sheet 1 and an organic material-coated steel sheet were obtained and evaluated in the same manner as in Example 1 except that the amounts of electricity in the electrolytic treatment using the electrolytic treatment solution containing phosphate ions were changed as follows: the amount of electricity in the cathode electrolytic treatment was 0.25 C/dm$^2$, and the amount of electricity in the anode electrolytic treatment was 0.25 C/dm$^2$. The results are shown in Table 1.

Example 3

A surface-treated steel sheet 1 and an organic material-coated steel sheet were obtained and evaluated in the same manner as in Example 1 except that the amounts of electricity in the electrolytic treatment using the electrolytic treatment solution containing phosphate ions were changed as follows: the amount of electricity in the cathode electrolytic treatment was 0.35 C/dm$^2$, and the amount of electricity in the anode electrolytic treatment was 0.35 C/dm$^2$. The results are shown in Table 1.

Example 4

A surface-treated steel sheet 1 and an organic material-coated steel sheet were obtained and evaluated in the same manner as in Example 1 except that the amounts of electricity in the electrolytic treatment using the electrolytic treatment solution containing phosphate ions were changed as follows: the amount of electricity in the cathode electrolytic treatment was 0.5 C/dm$^2$, and the amount of electricity in the anode electrolytic treatment was 0.5 C/dm$^2$. The results are shown in Table 1.

Comparative Example 1

A surface-treated steel sheet and an organic material-coated steel sheet were obtained and evaluated in the same manner as in Example 1 except that the amount of electricity in the cathode electrolytic treatment using the electrolytic treatment solution containing aluminum ions was changed to 6.2 C/dm$^2$ while the amounts of electricity in the electrolytic treatment using the electrolytic treatment solution containing phosphate ions were changed as follows: the amount of electricity in the cathode electrolytic treatment was 0.75 C/dm$^2$, and the amount of electricity in the anode electrolytic treatment was 0.75 C/dm$^2$. The results are shown in Table 1.

Comparative Example 2

A surface-treated steel sheet and an organic material-coated steel sheet were obtained and evaluated in the same manner as in Example 1 except that the amount of electricity in the cathode electrolytic treatment using the electrolytic treatment solution containing aluminum ions was changed to 6.0 C/dm$^2$ while the amounts of electricity in the electrolytic treatment using the electrolytic treatment solution containing phosphate ions were changed as follows: the amount of electricity in the cathode electrolytic treatment was 0.9 C/dm$^2$, and the amount of electricity in the anode electrolytic treatment was 0.9 C/dm$^2$. The results are shown in Table 1.

Comparative Example 3

A surface-treated steel sheet and an organic material-coated steel sheet were obtained and evaluated in the same manner as in Example 1 except that the electrolytic treatment using the electrolytic treatment solution containing phosphate ions and the cathode electrolytic treatment using the electrolytic treatment solution containing aluminum ions were not performed. The results are shown in Table 1.

Comparative Example 4

A surface-treated steel sheet and an organic material-coated steel sheet were obtained and evaluated in the same manner as in Example 2 except that the cathode electrolytic treatment using the electrolytic treatment solution containing aluminum ions was not performed. The results are shown in Table 1.

TABLE 1

| | Amount of tin plating [g/m²] | Electrolytic treatment in electrolytic treatment solution containing phosphote ions: Amount of electricity in cathode electrolytic treatment [C/dm²] | Electrolytic treatment in electrolytic treatment solution containing phosphote ions: Amount of electricity in anode electrolytic treatment [C/dm²] | Electrolytic treatment in electrolytic treatment solution containing Al ions [C/dm²] | Amount of P [mg/m²] | Amount of Al [mg/m²] | Thickness of tin oxide layer [nm] | Crystalline nature of $SnO_2$ in tin oxide layer | Contents of atoms in tin oxide layer: Sn [atomic %] | Al [atomic %] | P [atomic %] |
|---|---|---|---|---|---|---|---|---|---|---|---|
| Example 1 | 8.4 | 0.15 | 0.15 | 7.5 | 3.3 | 12.7 | 10 | Crystalline | 45 | 9 | 5 |
| Example 2 | 8.4 | 0.25 | 0.25 | 7.5 | 3.5 | 11.9 | 14 | Crystalline | 47 | 12 | 7 |
| Example 3 | 8.4 | 0.35 | 0.35 | 7.5 | 2.0 | 11.4 | 8 | Crystalline | 42 | 3 | 2 |
| Example 4 | 8.4 | 0.5 | 0.5 | 7.5 | 2.3 | 9.6 | 8 | Crystalline | 43 | 6 | 5 |
| Comparative Example 1 | 8.4 | 0.75 | 0.75 | 6.2 | 1.9 | 14.6 | 5 | Amorphous | 49 | 4 | 2 |
| Comparative Example 2 | 8.4 | 0.9 | 0.9 | 6.0 | 1.9 | 9.8 | 5 | Amorphous | 51 | 4 | 2 |
| Comparative Example 3 | 8.4 | — | — | — | — | — | 15 | Crystalline | 56 | — | — |
| Comparative Example 4 | 8.4 | 0.25 | 0.25 | — | 3.9 | — | 10 | Amorphous | 80 | 0 | 8 |

| | Contents of atoms in tin oxide layer: O [atomic %] | Fe [atomic %] | P/Al | Contents of atoms in composite oxide layer: Sn [atomic %] | Al [atomic %] | P [atomic %] | O [atomic %] | Fe [atomic %] | P/Al | Contents of atoms in aluminum-oxygen compound layer: Sn [atomic %] | Al [atomic %] |
|---|---|---|---|---|---|---|---|---|---|---|---|
| Example 1 | 39 | 2 | 0.6 | 12 | 15 | 17 | 55 | 1 | 1.13 | 8 | 33 |
| Example 2 | 31 | 3 | 0.6 | 12 | 17 | 21 | 48 | 2 | 1.24 | 17 | 26 |
| Example 3 | 48 | 5 | 0.7 | 10 | 23 | 15 | 51 | 1 | 0.65 | 3 | 35 |
| Example 4 | 43 | 3 | 0.8 | 10 | 22 | 10 | 57 | 1 | 0.45 | 11 | 32 |
| Comparative Example 1 | 43 | 2 | 0.5 | 8 | 35 | 4 | 52 | 1 | 0.11 | 16 | 29 |
| Comparative Example 2 | 41 | 2 | 0.5 | 9 | 34 | 3 | 52 | 2 | 0.09 | 18 | 26 |
| Comparative Example 3 | 43 | 1 | — | — | — | — | — | — | — | — | — |
| Comparative Example 4 | 6 | 6 | — | — | — | — | — | — | — | — | — |

| | Contents of atoms in aluminum-oxygen compound layer: P [atomic %] | O [atomic %] | Fe [atomic %] | P/Al | Evaluations: Surface appearance | Alkali resistance | Coating adhesion | Sulfide staining resistance |
|---|---|---|---|---|---|---|---|---|
| Example 1 | 5 | 53 | 1 | 0.15 | A | 3 | 5 | 5 |
| Example 2 | 6 | 49 | 2 | 0.23 | A | 5 | 5 | 5 |
| Example 3 | 2 | 59 | 1 | 0.06 | A | 4 | 4 | 5 |
| Example 4 | 4 | 52 | 1 | 0.13 | B | 3 | 4 | 4 |
| Comparative Example 1 | 5 | 48 | 2 | 0.17 | C | 1 | 3 | 3 |
| Comparative Example 2 | 6 | 47 | 3 | 0.23 | C | 1 | 2 | 3 |
| Comparative Example 3 | — | — | — | — | A | Not measured | 1 | 1 |
| Comparative Example 4 | — | — | — | — | A | Not measured | 1 | 1 |

Example 5

A surface-treated steel sheet 1 and an organic material-coated steel sheet were obtained and evaluated in the same manner as in Example 1 except that the current density and the total energization time in the tin-plating on the steel sheet 11 were changed to form tin plating layers 12 each containing 2.8 g/dm² of tin (the amount of tin on each side) and the amounts of electricity in the electrolytic treatment using the electrolytic treatment solution containing phosphate ions were changed as follows: the amount of electricity in the cathode electrolytic treatment was 0.05 C/dm², and the amount of electricity in the anode electrolytic treatment was 0.05 C/dm². The results are shown in Table 2.

Example 6

A surface-treated steel sheet 1 and an organic material-coated steel sheet were obtained and evaluated in the same manner as in Example 5 except that the amounts of electricity in the electrolytic treatment using the electrolytic treatment solution containing phosphate ions were changed as follows: the amount of electricity in the cathode electrolytic treatment was 0.15 C/dm$^2$, and the amount of electricity in the anode electrolytic treatment was 0.15 C/dm$^2$. The results are shown in Table 2.

Example 7

A surface-treated steel sheet 1 and an organic material-coated steel sheet were obtained and evaluated in the same manner as in Example 5 except that the amounts of electricity in the electrolytic treatment using the electrolytic treatment solution containing phosphate ions were changed as follows: the amount of electricity in the cathode electrolytic treatment was 0.25 C/dm$^2$, and the amount of electricity in the anode electrolytic treatment was 0.25 C/dm$^2$. The results are shown in Table 2.

Example 8

A surface-treated steel sheet 1 and an organic material-coated steel sheet were obtained and evaluated in the same manner as in Example 5 except that the amounts of electricity in the electrolytic treatment using the electrolytic treatment solution containing phosphate ions were changed as follows: the amount of electricity in the cathode electrolytic treatment was 0.35 C/dm$^2$, and the amount of electricity in the anode electrolytic treatment was 0.35 C/dm$^2$. The results are shown in Table 2.

Example 9

A surface-treated steel sheet 1 and an organic material-coated steel sheet were obtained and evaluated in the same manner as in Example 5 except that the amounts of electricity in the electrolytic treatment using the electrolytic treatment solution containing phosphate ions were changed as follows: the amount of electricity in the cathode electrolytic treatment was 0.5 C/dm$^2$, and the amount of electricity in the anode electrolytic treatment was 0.5 C/dm$^2$. The results are shown in Table 2.

Comparative Example 5

A surface-treated steel sheet and an organic material-coated steel sheet were obtained and evaluated in the same manner as in Example 5 except that the amount of electricity in the cathode electrolytic treatment using the electrolytic treatment solution containing aluminum ions was changed to 6.2 C/dm$^2$ while the amounts of electricity in the electrolytic treatment using the electrolytic treatment solution containing phosphate ions were changed as follows: the amount of electricity in the cathode electrolytic treatment was 0.75 C/dm$^2$, and the amount of electricity in the anode electrolytic treatment was 0.75 C/dm$^2$. The results are shown in Table 2.

Comparative Example 6

A surface-treated steel sheet and an organic material-coated steel sheet were obtained and evaluated in the same manner as in Example 5 except that the amount of electricity in the cathode electrolytic treatment using the electrolytic treatment solution containing aluminum ions was changed to 6.0 C/dm$^2$ while the amounts of electricity in the electrolytic treatment using the electrolytic treatment solution containing phosphate ions were changed as follows: the amount of electricity in the cathode electrolytic treatment was 0.9 C/dm$^2$, and the amount of electricity in the anode electrolytic treatment was 0.9 C/dm$^2$. The results are shown in Table 2.

Comparative Example 7

A surface-treated steel sheet and an organic material-coated steel sheet were obtained and evaluated in the same manner as in Example 5 except that the electrolytic treatment using the electrolytic treatment solution containing phosphate ions and the cathode electrolytic treatment using the electrolytic treatment solution containing aluminum ions were not performed. The results are shown in Table 2.

Comparative Example 8

A surface-treated steel sheet and an organic material-coated steel sheet were obtained and evaluated in the same manner as in Example 5 except that the cathode electrolytic treatment using the electrolytic treatment solution containing aluminum ions was not performed. The results are shown in Table 2.

TABLE 2

| | Amount of tin plating [g/m$^2$] | Electrolytic treatment in electrolytic treatment solution containing phosphote ions: Amount of electricity in cathode electrolytic treatment [C/dm$^2$] | Electrolytic treatment in electrolytic treatment solution containing phosphote ions: Amount of electricity in anode electrolytic treatment [C/dm$^2$] | Electrolytic treatment in electrolytic treatment solution containing Al ions [C/dm$^2$] | Amount of P [mg/m$^2$] | Amount of Al [mg/m$^2$] | Thickness of tin oxide layer [nm] | Crystalline nature of $SnO_2$ in tin oxide layer | Contents of atoms in tin oxide layer: Sn [atomic %] | Al [atomic %] | P [atomic %] |
|---|---|---|---|---|---|---|---|---|---|---|---|
| Example 5 | 2.8 | 0.05 | 0.05 | 7.5 | 1.5 | 10.5 | 8 | Crystalline | 41 | 7 | 8 |
| Example 6 | 2.8 | 0.15 | 0.15 | 7.5 | 3.3 | 11.8 | 8 | Crystalline | 40 | 8 | 11 |
| Example 7 | 2.8 | 0.25 | 0.25 | 7.5 | 3.8 | 12.2 | 14 | Crystalline | 43 | 10 | 10 |
| Example 8 | 2.8 | 0.35 | 0.35 | 7.5 | 1.6 | 16.5 | 10 | Crystalline | 46 | 7 | 8 |
| Example 9 | 2.8 | 0.5 | 0.5 | 7.5 | 1.9 | 13.0 | 8 | Crystalline | 44 | 7 | 9 |
| Comparative Example 5 | 2.8 | 0.75 | 0.75 | 6.2 | 1.9 | 15.7 | 6 | Crystalline | 45 | 3 | 3 |
| Comparative Example 6 | 2.8 | 0.9 | 0.9 | 6.0 | 2.3 | 9 | 7 | Crystalline | 47 | 4 | 3 |
| Comparative Example 7 | 2.8 | — | — | — | — | — | 15 | Crystalline | — | — | — |

TABLE 2-continued

| | | | | | | | | | | | |
|---|---|---|---|---|---|---|---|---|---|---|---|
| Comparative Example 8 | 2.8 | 0.25 | 0.25 | — | 3.9 | — | 8 | Amorphous | 76 | 0 | 10 |

| | Contents of atoms in tin oxide layer | | | Contents of atoms in composite oxide layer | | | | | | Contents of atoms in aluminum-oxygen compound layer | |
|---|---|---|---|---|---|---|---|---|---|---|---|
| | O [atomic %] | Fe [atomic %] | P/Al | Sn [atomic %] | Al [atomic %] | P [atomic %] | O [atomic %] | Fe [atomic %] | P/Al | Sn [atomic %] | Al [atomic %] |
| Example 5 | 42 | 2 | 1.1 | 18 | 25 | 5 | 50 | 2 | 0.20 | 11 | 20 |
| Example 6 | 36 | 5 | 1.4 | 20 | 27 | 7 | 41 | 5 | 0.26 | 7 | 20 |
| Example 7 | 33 | 4 | 1.0 | 9 | 30 | 7 | 52 | 2 | 0.23 | 20 | 17 |
| Example 8 | 35 | 4 | 1.1 | 15 | 25 | 6 | 50 | 4 | 0.24 | 13 | 21 |
| Example 9 | 34 | 6 | 1.3 | 12 | 22 | 6 | 54 | 6 | 0.27 | 8 | 19 |
| Comparative Example 5 | 43 | 6 | 1.3 | 10 | 10 | 7 | 67 | 6 | 0.70 | 5 | 19 |
| Comparative Example 6 | 40 | 6 | 1.3 | 16 | 10 | 7 | 61 | 6 | 0.70 | 2 | 19 |
| Comparative Example 7 | — | — | — | — | — | — | | | — | — | — |
| Comparative Example 8 | 8 | 6 | — | — | — | — | — | — | — | — | — |

| | Contents of atoms in aluminum-oxygen compound layer | | | | Evaluations | | | |
|---|---|---|---|---|---|---|---|---|
| | P [atomic %] | O [atomic %] | Fe [atomic %] | P/Al | Surface appearance | Alkali resistance | Coating adhesion | Sulfide staining resistance |
| Example 5 | 1 | 65 | 3 | 0.05 | A | 4 | 5 | 5 |
| Example 6 | 3 | 68 | 2 | 0.15 | A | 4 | 5 | 5 |
| Example 7 | 1 | 57 | 5 | 0.06 | A | 5 | 5 | 5 |
| Example 8 | 2 | 59 | 5 | 0.10 | A | 5 | 5 | 5 |
| Example 9 | 2 | 67 | 4 | 0.11 | B | 4 | 5 | 4 |
| Comparative Example 5 | 5 | 68 | 3 | 0.26 | C | 3 | 4 | 3 |
| Comparative Example 6 | 5 | 71 | 3 | 0.26 | C | 3 | 4 | 3 |
| Comparative Example 7 | — | | | — | A | Not measured | 1 | 1 |
| Comparative Example 8 | — | — | — | — | A | Not measured | 1 | 1 |

As shown in Tables 1 and 2, the surface-treated steel sheets 1 of Examples 1 to 9, which had a tin oxide layer 20, a composite oxide layer 30, and an aluminum-oxygen compound layer 40 in the stated order on a tin-plated steel sheet 10, the tin oxide layer 20 having a thickness of 8 to 20 nm, had a good surface appearance, excellent sulfide staining resistance and alkali resistance, and high adhesion to the coating layer. Additionally, all the tin oxide layers 20 of the surface-treated steel sheets 1 of Examples 1 to 9 showed a diffraction pattern arising from the crystalline structure of tin(IV) oxide ($SnO_2$) when the tin oxide layers 20 were subjected to diffraction pattern analysis by nano-beam electron diffraction using a transmission electron microscope. In other words, the tin oxide layers 20 had the crystalline structure of tin(IV) oxide ($SnO_2$). FIG. 2 shows the diffraction pattern of the tin oxide layer 20 of Example 7 obtained by nano-beam electron diffraction using a transmission electron microscope.

In contrast, Comparative Examples 1, 2, 5, and 6, in which the tin oxide layers 20 had a thickness of less than 8 nm, had a poor surface appearance, and Comparative Examples 1 and 2, in which the tin oxide layers 20 had a thickness of less than 8 nm and the amount of tin plating was as large as 8.4 g/m$^2$, had poor alkali resistance as well as a poor surface appearance.

The surface-treated steel sheets of Comparative Examples 3, 4, 7, and 8, which did not have the tin oxide layer 20, the composite oxide layer 30, and the aluminum-oxygen compound layer 40, had poor sulfide staining resistance and low adhesion to the coating layer. The composition analysis (EDS analysis) of Comparative Examples 4 and 8 revealed that their coatings were mainly made of Sn. From this fact, it is presumed that tin ions $Sn^{2+}$ generated from the tin-plated steel sheets 10 received electrons during the electrolytic treatments and were precipitated as tin on the surfaces. This is presumed to have occurred because as a result of the electrolytic treatment using the electrolytic treatment solution containing phosphate ions, dissolved tin ions $Sn^{2+}$ were reprecipitated on the surfaces together with P in the treatment bath as shown in FIG. 3A.

Figure 5:
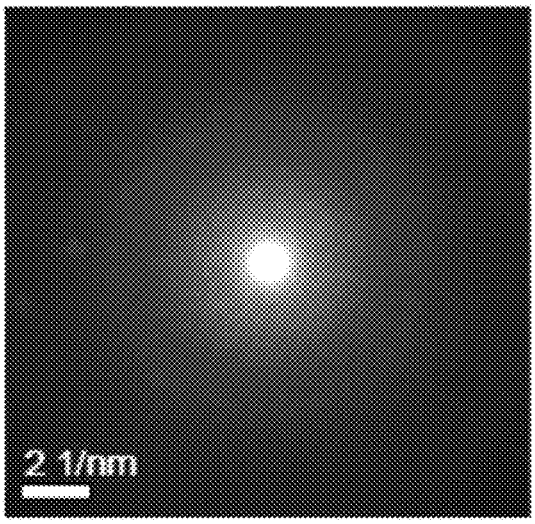
FIG. 5 is a view illustrating a diffraction pattern of a tin oxide layer 20 of Comparative Example 4 obtained by nano-beam electron diffraction using a transmission electron microscope.

The diffraction pattern analysis on the tin oxide layers 20 in Comparative Examples 1 to 3 and 5 to 7 by nano-beam electron diffraction using a transmission electron microscope revealed that all the tin oxide layers 20 did not show a diffraction pattern arising from the crystalline structure of tin (IV) oxide ($SnO_2$). FIG. 5 shows the diffraction pattern of the tin oxide layer 20 in Comparative Example 4 obtained by nano-beam electron diffraction using a transmission electron microscope.

REFERENCE SIGNS LIST

1 surface-treated steel sheet
10 tin-plated steel sheet

11 steel sheet
12 tin plating layer
20 tin oxide layer
30 composite oxide layer
40 aluminum-oxygen compound layer

The invention claimed is:

1. A method for manufacturing a surface-treated steel sheet comprising:

a first step of providing a tin-plated steel sheet having a tin plating on a steel sheet;

a second step of subjecting the tin-plated steel sheet to an electrolytic treatment in an electrolytic treatment solution containing phosphate ions with 0.1 $C/dm^2$ or more and 1.0 $C/dm^2$ or less of electricity; and a third step of subjecting the tin-plated steel sheet subjected to the electrolytic treatment in the second step to a cathode electrolytic treatment in an electrolytic treatment solution containing aluminum ions, wherein the electrolytic treatment in the second step includes performing a cathode electrolytic treatment and then performing an anode electrolytic treatment.

* * * * *